US005582371A

United States Patent [19]

Humphrey et al.

[11] Patent Number: 5,582,371

[45] **Date of Patent: * Dec. 10, 1996**

[54] RAIL FLANGE SECUREMENT CLAMP

[76] Inventors: John Humphrey, R.R. 1, Box 131, Walnut, Iowa 51577; Dean Wieser, 706 Hickory St., Atlantic, Iowa 50022

[ * ] Notice: The term of this patent shall not extend beyond the expiration date of Pat. No. 5,501,418.

[21] Appl. No.: 517,374

[22] Filed: Aug. 21, 1995

[51] Int. Cl.[6] ..... E01B 7/00

[52] U.S. Cl. ..... 246/453; 238/338

[58] Field of Search ..... 246/415 R, 430, 246/435 R, 442, 453; 238/338, 340, 341, 342, 349

[56] References Cited

U.S. PATENT DOCUMENTS

| | | | |
|---|---|---|---|
| 726,613 | 4/1903 | Anderson . | |
| 1,455,996 | 5/1923 | Einstein . | |
| 1,965,803 | 7/1934 | Post et al. | 246/453 |
| 2,009,309 | 7/1935 | Davies et al. | 238/338 |
| 2,177,148 | 10/1939 | Newhall | 287/58 |
| 2,471,357 | 5/1949 | Smith | 246/453 |
| 2,533,929 | 12/1950 | Gray et al. | 246/453 |
| 3,952,481 | 4/1976 | Albertsen | 53/392 |
| 4,059,054 | 11/1977 | Alimanestianu et al. | 104/88 |
| 4,327,865 | 5/1982 | Greene | 238/349 |
| 5,390,881 | 2/1995 | Benenowski et al. | 246/453 |

FOREIGN PATENT DOCUMENTS

| | | | |
|---|---|---|---|
| 1056641 | 2/1957 | Germany | 246/453 |
| 325977 | 3/1930 | United Kingdom | 246/453 |
| 415153 | 9/1934 | United Kingdom . | |
| 2222426 | 3/1990 | United Kingdom | 238/338 |

*Primary Examiner*—S. Joseph Morano
*Attorney, Agent, or Firm*—Aupperle & Jacobs, P.C.

[57] ABSTRACT

A rail flange securement clamp for adjustably mounting a switch point roller assist apparatus on a railroad rail includes a base plate and a top plate, the top plate generally upwardly spaced from the base plate and an adjustable connection device extending between and connecting the base plate and top plate for increasing and decreasing the distance between the base plate and top plate. A rail flange engagement plate having a base section and a rail flange engagement section is adjustably mounted on the securement clamp above the top plate such that the base section is mounted above the top plate and the rail flange engagement section extends outwardly from the top plate for engagement of a flange of a railroad rail thus securing a switch point roller assist apparatus on the railroad rail.

8 Claims, 3 Drawing Sheets

RAIL FLANGE SECUREMENT CLAMP

BACKGROUND OF THE INVENTION

1. Technical Field

This invention relates to securement clamps for switch point roller assist devices and, more particularly, to a rail flange securement clamp for adjustably mounting a switch point roller assist apparatus on a railroad rail which includes a base plate, a top plate generally upwardly spaced from the base plate, an adjustable connection extending between and connecting the base plate and top plate for increasing and decreasing the distance between the base plate and top plate and a rail flange engagement plate having a base section and rail flange engagement section, the plate adjustably mounted on the clamp above the top plate such that the base section of the plate is mounted above the top plate and the rail flange engagement section extends outwardly from the top plate for engagement of a flange of a railroad rail thereby securing a switch point roller assist apparatus on a railroad rail.

2. Description of the Prior Art

Railroad switching devices usually comprise tapered metal blades or tongues which set alternative routes of running rails. The term "turnout" is also used to denote a curved track leading from one track to another which takes place at a switching point. The commonest form of switch is the split switch in which one rail of the main track and the outer rail of the turnout are continuous. The point rails are connected respectively to the second rail of the main track and the inner rail of the turnout. The switch operates in the following manner: when the point rail connected to the second rail of the main track is in contact with the outer rail of the turnout, a locomotive traveling on the main track will continue on the main track; when the point rail connected to the inner rail of the turn out is in contact with the first rail of the main track, a locomotive traveling on the main track will be switched over to the turnout. The point rail is spaced such that in no circumstances can both point rails be in contact with an adjacent rail of the main track of the turnout.

To switch the point rails from contact with one rail of the main track to contact with the outer rail of the turnout and vice versa, both hand-operated and power-assisted switches are used. However, in both types of switches, the tapered ends of the point rails rest on a flat metal plate over which the ends of the point rails are slid. It is desirable to substantially reduce the friction between the tapered ends of the point rails and the flat metal plate from which they rest. Various devices have been proposed and constructed which remove the point rails from contact with the metal plate or the point rails are being moved, yet return the point rails to contact with the metal plate upon being moved into correct position.

One such device for assisting movement of the point rails is a switch point roller assist device manufactured by various companies. Such roller assist devices commonly include an elongated main support structure, a tie bar mounted generally perpendicular to the main support structure at one end of the structure, a clamping device for securing the opposite end of the main support structure to the outer flange of a railroad rail and one or more rollers rotatably mounted on the main support structure generally perpendicular thereto. The rollers are intended to lift the point rail slightly above the metal plate such that the point rail may be slid across the rollers.

Many of the problems encountered in using such switch point assist roller devices are found in the clamping device which secures the outer end of the main support structure to the flange of the railroad rail. Commonly, a switch point assist roller device would include an extended C-channel main support section having a longitudinally extended slot formed in the base of the C-channel adjacent the outer end of the main support structure. A standard clamping device for securing the C-channel main support structure to the flange of the railroad rail would consist of a flange engagement plate having a lower flange engagement face at one end of the plate and a bolt hole at the opposite end of the plate. A bolt would extend through the longitudinally extended slot in the C-channel main support structure and through the bolt hole in the flange engagement plate. The flange engagement face of the plate is slid over the upper slanted surface of the rail flange and the bolt is tightened down, thus securing the rail flange between the C-channel and the flange engagement plate. Because of the sloping upper surface of the rail flange, however, and because the rail flange plate is only secured to the C-channel by a single bolt, over a period of time the flange securement plate slides off of the flange and the switch point roller assist device loses contact with the rail flange. The switch point roller assist device thus becomes ineffective for lifting the point rails for ease of movement. There is therefore a need for an improved clamping device for securing the outer end of the main support structure to the flange of the railroad rail.

Therefore, an object of the present invention is to provide an improved clamping device for securing the outer end of the switch point roller assist device to the flange of a railroad rail.

Another object of the present invention is to provide a rail flange securement clamp which includes a base plate and a top plate for "sandwiching" the main support section of a switch point roller assist device, adjustable connection bolts for drawing the base plate and top plate towards one another to frictionally secure the plates on the main support structure and a rail flange engagement plate for securing the rail flange between the engagement plate and the switch point roller assist device.

Another object of the present invention is to provide a rail flange securement clamp which will frictionally engage the main support structure in addition to frictionally engaging the flange of the railroad rail to prevent slippage of the securement clamp off of the rail flange.

Another object of the present invention is to provide a rail flange securement clamp which may be quickly and easily adjusted to secure the switch point roller assist device in a particular location on the railroad rail such that the switch point roller assist device may more efficiently operate.

Another object of the present invention is to provide a rail flange securement clamp which may be used in connection with variously shaped and sized switch point roller assist devices.

Finally, an object of the present invention is to provide a rail flange securement clamp which is relatively simple and durable in construction and is safe and efficient in use.

SUMMARY OF THE INVENTION

The present invention provide a rail flange securement clamp for adjustably mounting a switch point roller assist apparatus on a railroad rail. The clamp includes a base plate and a top plate, the top plate being generally upwardly spaced from the base plate. Adjustable connection devices such as nuts and bolts extend between and connect the base plate and top plate for increasing and decreasing the vertical distance between the base plate and top plate. The base plate and top plate preferably "sandwich" the main support section of a switch point roller assist apparatus and therefore when the base plate and top plate are drawn towards one another, the clamp is frictionally secured on the main support section. Finally, a rail flange engagement plate having a base section and a rail flange engagement section is adjustably mounted on the clamp above the top plate such that the base section of the rail flange engagement plate is mounted above the top plate and the rail flange engagement section extends outwardly from the top plate for engagement of a flange of a railroad rail thereby securing the switch point roller assist apparatus on a railroad rail.

The rail flange securement clamp of the present invention thus provides a substantial improvement over those clamps found in the prior art. Because the clamp is frictionally secured to both the rail flange and to the main support section of the switch point roller assist apparatus, the possibilities of slippage of the rail flange securement clamp off of the rail flange are greatly reduced. Furthermore, because of the design of the rail flange securement clamp of the present invention, the clamp may be applied to variously shaped and sized switch point roller assist devices presently being used in the railroad industry without requiring modification of either the rail flange securement clamp or the switch point roller assist device. Finally, the design of the rail flange securement clamp of the present invention allows for simple and quick adjustment of the position of the rail flange securement clamp on the switch point roller assist apparatus, thus enabling quick adjustment of the position of the rollers on the switch point roller assist apparatus relative to the point rail. It is thus seen that the rail flange securement clamp of the present invention provides a substantial improvement over those devices found in the prior art.

DESCRIPTION OF THE PREFERRED EMBODIMENT

Figure 5:
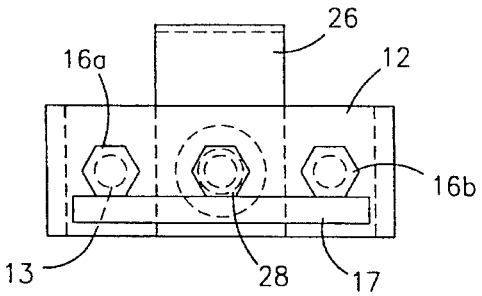
FIG. 5 is a bottom plan view of the clamp.
Figure 6:
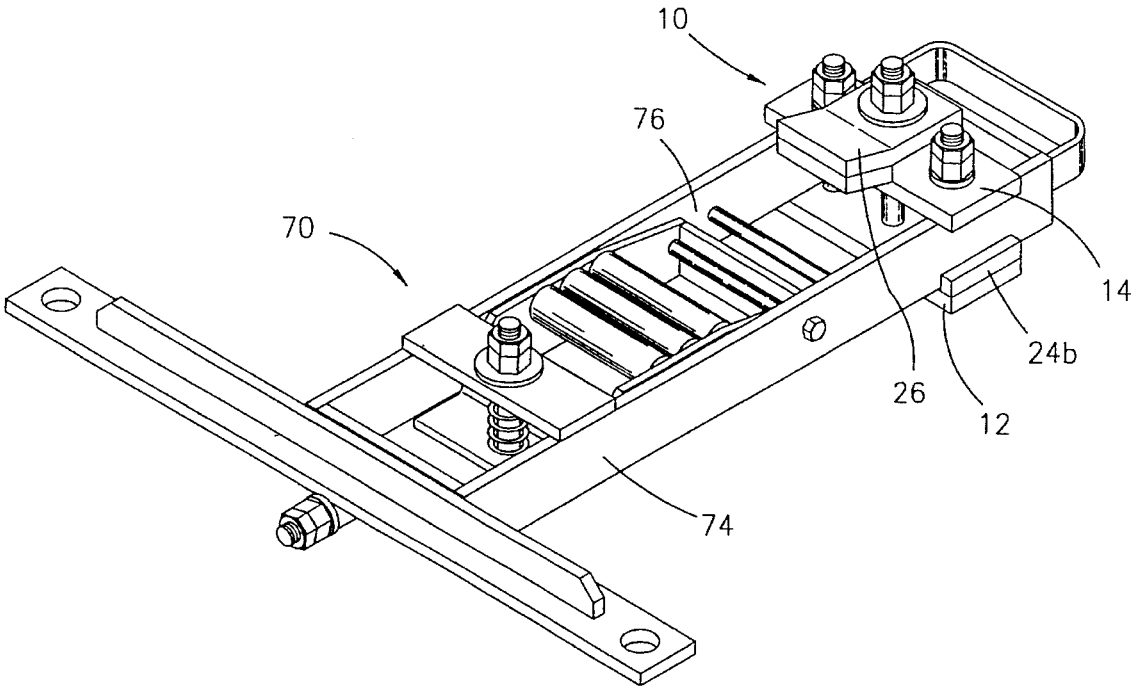
FIG. 6 is a perspective view of the clamp of the present invention in place on a switch point roller assist apparatus.
Figure 7:
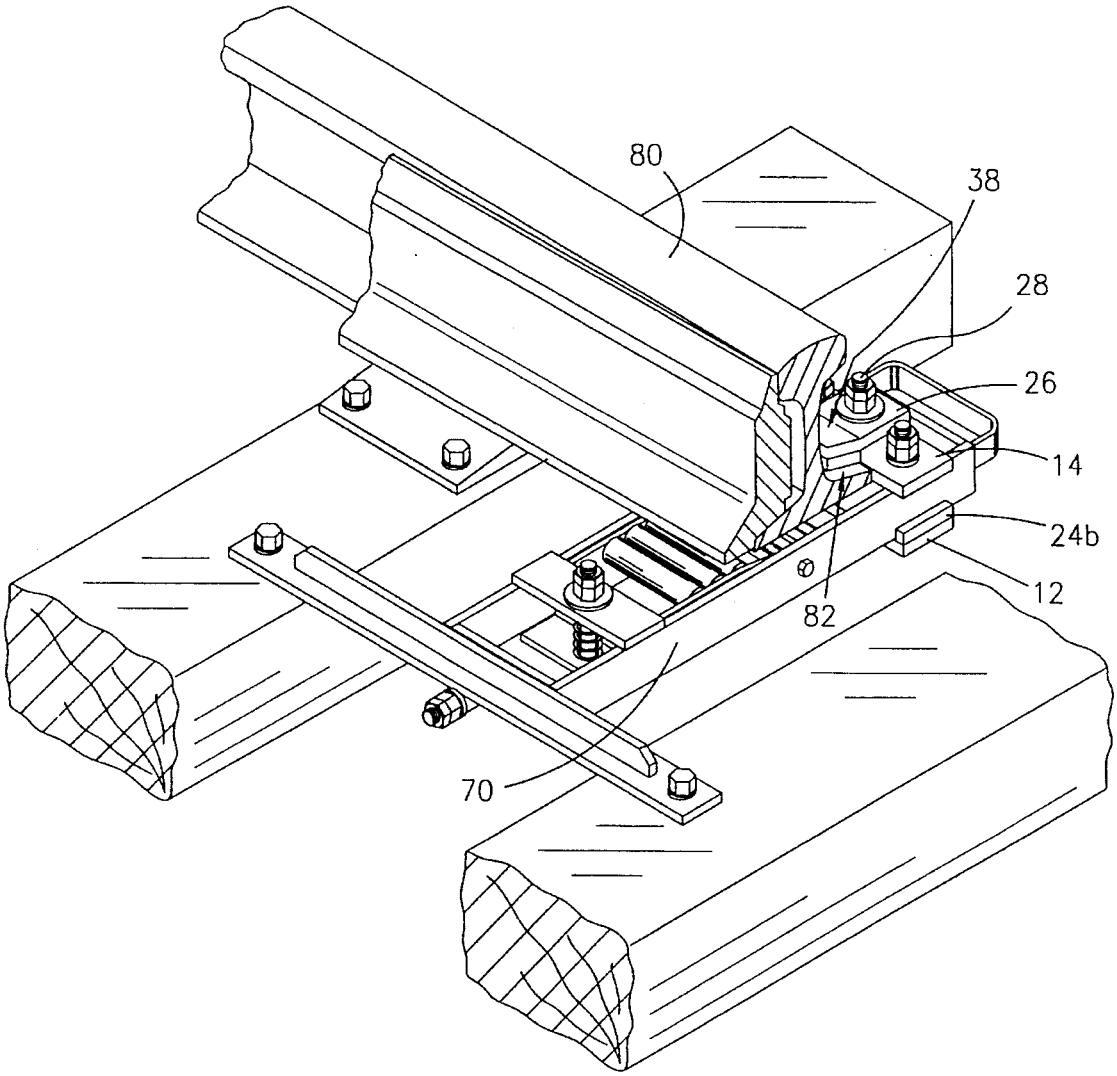
FIG. 7 is a perspective view of the clamp of the present invention securing a switch point roller assist apparatus to the flange of a railroad rail.

The rail flange securement clamp 10 of the present invention is best shown in FIG. 1–5 as including a rectangular base plate 12 and a similarly dimensioned top plate 14. It is preferred that base plate 12 and top plate 14 each be between 4" and 10" in width, 1" and 4" in length and have a thickness between ⅛" and ¾". Briefly, throughout this specification, the term "width" shall refer to the transverse dimension of the clamp relative to the longitudinal axis of the switch point roller assist apparatus 70, as best shown in FIGS. 6 and 7, the term "length" shall refer to the longitudinal dimension parallel with the longitudinal axis of the switch point roller assist apparatus 70 and the term "thickness" is believed to be self-explanatory. Also, it is preferred that all elements of the rail flange engagement clamp 10 be constructed of high tensile strength steel or the like to provide the necessary strength and durability for the clamp.

Of course, the dimensions of the rail flange securement clamp 10 are not critical to the present invention and may be modified to allow the clamp 10 to be used on a wide variety of differently shaped and sized switch point roller assist devices. In any event, it is preferred that base plate 12 and top plate 14 extend outwards past the outer edges of the switch point roller assist apparatus 70 at least ½" to ensure that the rail flange securement clamp 10 will not become dislodged from the switch point roller assist apparatus 70. Also, the thickness of base and top plates 12 and 14 should be substantial enough to prevent severe deflection of the plates upon the plates being drawn towards one another.

Extending between base plate 12 and top plate 14 are a pair of distance adjustment bolts **16*a* and 16*b* which extend upwards from beneath base plate 12 through bolt holes 13 in base plate 12 and through bolt holes 15 in top plate 14, distance adjustment bolts 16*a* and 16*b* being secured in place by washers 18*a* and 18*b* and double nuts 20*a* and 20*b*. It is preferred that bolts 16*a* and 16*b* be approximately 2 to 6 inches in length to provide for sufficient adjustability for clamp 10 so that the clamp 10 may be fitted to a variety of switch point roller assist devices. Additionally, as used herein, the term "double nuts" will commonly refer to a nut and jam nut combination which acts to prevent undesired rotation of the nut on the distance adjustment bolt on which it is secured. Alternatively, double nuts 20*a* and 2O*b* and washers 18*a* and 18*b* may be replaced by lock nuts using nylon bushings or the like, so long as the securement means used to secure the base plate 12 and top plate 14 to the switch point roller assist apparatus 70 will reliably lock the rail flange securement clamp 10 in place. Base plate 12 preferably also includes a bolt stop bar 17 mounted on the underside of base plate 12 adjacent bolt holes 13, as shown in FIG. 5. Bolt stop bar 17 is preferably a ½" square metal rod welded to base plate 12. Bolt stop bar 17 engages the bolt heads of distance adjustment bolts 16*a* and 16*b* and bolt 28 (discussed later) to prevent rotation of bolts 16*a*, 16*b* and 28** when being tightened.

Of course, when base plate 12 and top plate 14 are drawn towards one another by tightening of double nuts **20*a* and 20*b*, the base plate 12 and top plate 14 may bow towards one another in the center of each plate. To prevent this, and to provide additional structural rigidity to the entire clamp 10 structure, a clamp spacer tube 22 may be provided which surrounds bolt 28 and is positioned between base and top plates 12 and 14. It is preferred that clamp spacer tube 22 have a length slightly less that the height of the switch point roller assist apparatus 70 on which the clamp 10 is to be mounted. This will allow base plate 12 and top plate 14 to be drawn towards one another to frictionally secure the clamp 10 on the switch point roller assist apparatus 70 yet will prevent base plate 12 and top plate 14 from substantially deflecting on tightening of double nuts 20*a* and 20*b*. Alternatively, the thickness of base and top plates 12 and 14** may be increased to prevent bowing thereof or additional clamp spacer tubes or rods may be provided.

Base plate 12 may further include a pair of guide blocks **24*a* and 24*b* which cooperate with base plate 12 and top plate 14 to secure the rail flange securement clamp 10 on the switch point roller assist apparatus 70 and prevent rotation of the clamp 10. It is to be understood that guide blocks 24*a* and 24*b* may be replaced with any equivalent guide mechanism and further may be positioned on top plate 14 if so desired. As shown in FIGS. 6 and 7, switch point roller assist apparatus 70 includes first and second side bars 72 and 74 which form the main support section of switch point roller assist apparatus 70. Top plate 14 and base plate 12 sandwich the first and second side bars 72 and 74 between the plates and the guide blocks 24***a* and 24*b* prevent the base plate 12 from rotating on the switch point roller assist apparatus 70. Therefore, movement of rail flange securement clamp 10 is only allowed parallel with the center longitudinal axis of the switch point roller assist apparatus 70.

The rail flange securement clamp 10 is secured in place on the switch point roller assist apparatus 70 by the tightening of double nuts 20*a* and 20*b* which draws base plate 12 towards top plate 14 through movement of the distance adjustment bolts 16*a* and 16*b*, and thus rail flange securement clamp 10 is frictionally secured in a particular position on the switch point roller assist apparatus 70. Movement towards the outer and inner ends of the switch point roller assist apparatus 70 before securement may be restricted by various means, all of which would be understood by one skilled in the art.

Figure 1:
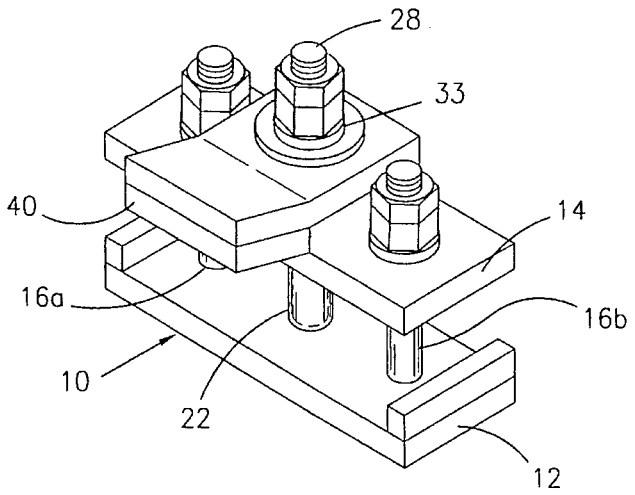
FIG. 1 is a perspective view of the rail flange securement clamp of the present invention.
Figure 2:
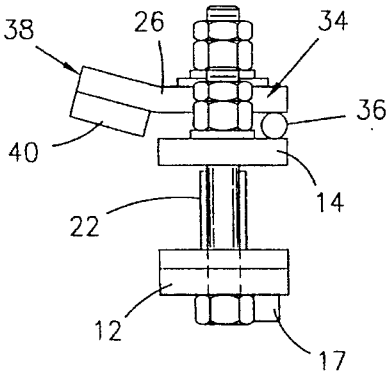
FIG. 2 is a side elevational view of the clamp.
Figure 3:
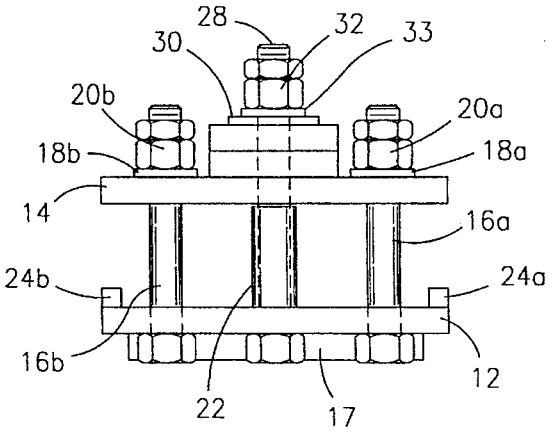
FIG. 3 is a rear elevational view of the clamp.
Figure 4:
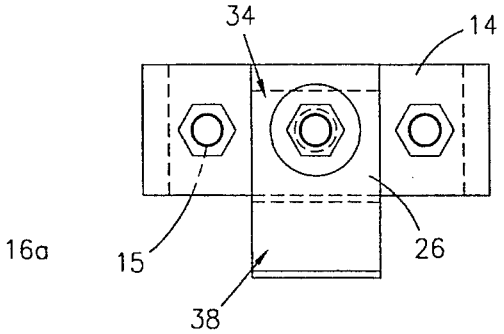
FIG. 4 is a top plan view of the clamp.

Mounted above top plate 14 on rail flange securement clamp 10 is a rail flange engagement plate 26 which is adjustably secured to rail flange securement clamp 10 by a bolt 28 which extends upwards from beneath base plate 12 through base plate 12, through top plate 14, through rail flange engagement plate 26 and is secured in place by a washer 30 and double nut 32, as shown best in FIGS. 1–3. A lock washer 33 may also be included on bolt 28 (as shown in FIGS. 1 and 3) to prevent unwanted rotation of double nut 32. Rail flange engagement plate 26 preferably includes a generally flat base section 34 under which is mounted a pivot rod 36 and an upwardly tilted flange-engaging section 38 which extends inwards past the edge of top plate 14 towards one end of the switch point roller assist apparatus 70. It is preferred that flange-engaging section 38 be upwardly tilted to better engage the flange 82 of main rail 80, as shown in FIG. 7. Flange-engaging section 38 may also include a flange-engaging block 40 mounted on the underside of flange-engaging section 38 which provides a better contact surface for frictionally securing the rail flange engagement plate 26 on the rail flange 82. Of course, flange-engaging section 38 also may extend inwards parallel with the base section 34 so long as at least part of the flange-engaging section 38 will engage the flange 82 of the rail 80. Additionally, it is preferred that pivot rod 36 be positioned adjacent the rear edge of base section 34 such that bolt 28 is positioned between pivot rod 36 and flange-engaging section 38. Therefore, when double nut 32 is rotated on bolt 28 to press downwards on base section 34, flange-engaging section 38 pivots downwards with the pivot axis being adjacent the pivot rod 36.

The preferred connection of the rail flange securement clamp 10 to the main rail 80 is described below, but it is to be understood that although the following description is given in relation to the switch point roller assist apparatus 70 shown in FIGS. 6 and 7, the rail flange securement clamp 10 of the present invention is designed to be used in a similar fashion with a variety of switch point roller assist devices. In the present embodiment, the switch point roller assist apparatus 70 would be slid underneath the main rail 80 and double nut 32 on bolt 28 would be loosened to allow the rail flange engagement plate 26 to be moved upwards. The first and second side bars 72 and 74 of the switch point roller assist apparatus 70 are moved upwards until contacting the lower surface of main rail 80, and it is at this point that the rail flange securement clamp 10 is slid towards main rail 80 until flange-engaging section 38 of rail flange engagement plate 26 is positioned above the rail flange 82. Once the rail flange securement clamp 10 is in a desired location on the first and second side bars 72 and 74, double nuts 20*a* and 20*b* are tightened, thus drawing base plate 12 towards top plate 14 and frictionally securing rail flange securement clamp 10 on first and second side bars 72 and 74 of switch point roller assist apparatus 70. Following securement of rail flange securement clamp 10, rail flange engagement plate 26 is secured to the flange 82 of main rail 80 by engagement of flange-engaging section 38 with flange 82. Double nut 32 is tightened, pivoting flange-engaging section 38 about pivot rod 36 and therefore forcing flange-engaging section 38 and, if present, flange-engaging block 40 into contact with flange 82 and thus clamping flange 82 between flange-engaging block 40 or flange-engaging section 38 and first and second side bars 72 and 74.

The rail flange securement clamp 10 thus securely clamps the switch point roller assist apparatus 70 to main rail 80. Movement of clamp 10 is prevented due to the frictional securement of clamp 10 on first and second side bars 72 and 74 of the switch point roller assist apparatus 70 and because of the upward tilt of flange-engaging section 38. It is this unique combination of separate securement devices for rail flange securement clamp 10 on the switch point roller assist apparatus 70 and the flange-engaging section 38 of rail flange engagement plate 26 on flange 82 of main rail 80 which provides the exceptional securement characteristics of the present invention.

Of course, it is to be understood that numerous modifications, additions and substitutions may be made to the rail flange securement clamp 10 of the present invention which fall within the intended broad scope of the appended claims. For example, the number of distance adjustment bolts extending between the base plate 12 and top plate 14 may be modified to provide for additional securement if so desired. Alternatively, the distance adjustment bolts may be replaced by C-clamps or the like, so long as the vertical adjustability of the securement clamp 10 is retained. Also, the location of the various elements of the clamp 10 may be modified such that clamp 10 may be fitted onto the widest possible variety of switch point roller assist devices. Finally, the precise dimensions of the various elements of the rail flange securement clamp 10 may be modified so long as the general function of the securement clamp 10 is not impaired.

There has thus been set forth and described a rail flange securement clamp which accomplishes at least all of the stated objectives.

I claim:

1. A rail flange securement clamp for adjustably mounting a switch point roller assist apparatus on a railroad rail comprising;

base plate means;

top plate means generally upwardly spaced from said base plate means;

adjustable connection means extending between and connecting said base plate means and said top plate means for increasing and decreasing the distance between said base plate means and said top plate means;

rail flange engagement plate means having a base section and a rail flange engagement section, said rail flange engagement plate means adjustably mounted on said clamp above said top plate means such that said base section is mounted above said top plate means and said rail flange engagement section extends outwardly from said top plate means; and said adjustable connection means extending between and connecting said base plate means and said top plate means being separately adjustable from said adjustably mounted rail flange engagement plate means such that the distance between said base plate means and said top plate means is adjustable independently of adjustment of said rail flange engagement plate means.

2. The rail flange securement clamp of claim 1 wherein said base plate means and said top plate means each comprise a generally rectangular flat metal plate having a plurality of bolt holes formed therein and extending transversely therethrough.

3. The rail flange securement clamp of claim 2 wherein said adjustable connection means comprises at least one bolt extending through a pair of said bolt holes, one bolt hole in each of said base plate and said top plate, said bolt being secured in said bolt holes by at least one nut threadably mounted on said bolt such that rotation of said at least one nut on said bolt alternately increases and decreases the vertical distance between said base plate means and said top plate means.

4. The rail flange securement clamp of claim 3 further comprising at least one clamp spacer tube slidably housing at least one clamp spacer tube bolt intermediate said base plate means and said top plate means, said clamp spacer tube operative to restrict motion of said top plate means towards said base plate means whereby said base plate means and said top plate means are kept in spaced relation.

5. The rail flange securement clamp of claim 1 wherein said rail flange engagement plate means further comprises a pivot bar mounted on a bottom surface of said base section such that said pivot bar is positioned between said base section and said top plate means.

6. The rail flange securement clamp of claim 5 wherein said rail flange engagement plate means is adjustably mounted on said clamp by a bolt and nut combination, said bolt extending through said base section of said rail flange engagement plate means and positioned between said pivot bar and said rail flange engagement section such that rotation of said nut on said bolt alternatively pivots said rail flange engagement section up and down.

7. The rail flange securement clamp of claim 6 wherein said bolt extends through said base plate means and through said top plate means such that said rail flange engagement plate means is securely adjustably fastened to said rail flange securement clamp.

8. A rail flange securement clamp adjustably mounted on a switch point roller assist apparatus including a main support structure having a center longitudinal axis, a tie bar mounted on one end of the main support structure generally perpendicular thereto and at least one roller mounted on the main support structure, said clamp comprising;

base plate means;

top plate means generally vertically spaced from said base plate means;

said base plate means and said top plate means in operative relation to the main support structure of the switch point roller assist apparatus such that said base plate means is positioned below the main support structure and said top plate means is positioned above the main support structure;

adjustable connection means extending between and connecting said base plate means and said top plate means for increasing and decreasing the distance between said base plate means and said top plate means such that decreasing the distance between said base plate means and said top plate means results in said base plate means and said top plate means frictionally engaging the main support structure thereby releasably securing said securement clamp on the switch point roller assist apparatus; and rail flange engagement plate means having a base section and a rail flange engagement section, said rail flange engagement plate means adjustably mounted on said clamp above said top plate means such that said base section is mounted above said top plate means and said rail flange engagement section extends outwardly from said top plate means.

* * * * *